US009097092B2

(12) United States Patent
Gillan

(10) Patent No.: US 9,097,092 B2
(45) Date of Patent: Aug. 4, 2015

(54) SCALE REMOVAL ASSEMBLY

(75) Inventor: Peter Gillan, Denend (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 135 days.

(21) Appl. No.: 12/186,794

(22) Filed: Aug. 6, 2008

(65) Prior Publication Data

US 2010/0032154 A1 Feb. 11, 2010

(51) Int. Cl.
*E21B 37/00* (2006.01)
*E21B 37/06* (2006.01)
*E21B 33/12* (2006.01)

(52) U.S. Cl.
CPC ..... *E21B 37/06* (2013.01); *E21B 33/12* (2013.01); *E21B 37/00* (2013.01)

(58) Field of Classification Search
CPC ..... E21B 23/08; E21B 23/10; E21B 23/01; E21B 37/00; E21B 37/04; E21B 37/06
USPC ..... 166/174, 312, 311, 382, 222, 223
See application file for complete search history.

(56) References Cited

U.S. PATENT DOCUMENTS 3,892,274 A * 7/1975 Dill ..... 166/222
4,485,874 A 12/1984 Meyers
4,621,694 A 11/1986 Wilson et al.
4,671,360 A 6/1987 Jennings et al.
5,010,958 A * 4/1991 Meek et al. ..... 166/382
5,059,333 A 10/1991 Hen
5,146,988 A 9/1992 Paul
5,183,112 A 2/1993 Paul et al.
5,360,062 A * 11/1994 White ..... 166/105
5,360,065 A * 11/1994 Falk ..... 166/250.05
5,381,631 A * 1/1995 Raghavan et al. ..... 451/75
5,795,402 A * 8/1998 Hargett et al. ..... 134/8
6,527,869 B1 * 3/2003 Bourg ..... 134/1
6,924,253 B2 8/2005 Palmer et al.
2005/0061503 A1 * 3/2005 Misselbrook et al. ..... 166/278
2005/0178551 A1 * 8/2005 Tolman et al. ..... 166/297
2007/0227745 A1 * 10/2007 Roberts et al. ..... 166/386
2008/0234147 A1 9/2008 Li et al.

* cited by examiner

*Primary Examiner* — Brad Harcourt
(74) *Attorney, Agent, or Firm* — Trevor Grove

(57) ABSTRACT

An assembly for cleanout of scale buildup from a wall of a hydrocarbon well. The assembly is configured to be deployed and operated under pressure without the requirement of coiled tubing to deliver cleanout fluid. The assembly may include a plug for sealing against the wall of the well immediately above the location of scale buildup. A cleanout tool, such as a jetting nozzle may be coupled to the downhole side of the plug. Thus, fluid and pressure may be provided to the well uphole of the plug. In this manner, the plug may direct the fluid to the jetting nozzle to achieve cleanout of the scale buildup.

20 Claims, 6 Drawing Sheets

SCALE REMOVAL ASSEMBLY

FIELD OF THE INVENTION

Embodiments described relate to scale removal tools and techniques. In particular, embodiments of tools are described that may be deployed without coiled tubing and related equipment at the oilfield. In particular, embodiments are disclosed which include wireline deployed scale removal tools and techniques. These tools and techniques may employ pressurization control over uphole scale removal fluid, particles, beeds, penetrants or abrasives through the use of a plug or mandrel type anchor and jetting assembly without the requirement of a separate coiled tubing line.

BACKGROUND OF THE RELATED ART

Exploring, drilling and completing hydrocarbon wells are generally complicated, time consuming and ultimately very expensive endeavors. As a result, over the years increased attention has been paid to monitoring and maintaining the health of such wells. Significant premiums are placed on maximizing the total hydrocarbon recovery, recovery rate, and extending the overall life of the well as much as possible. Thus, logging applications for monitoring of well conditions play a significant role in the life of the well. Similarly, significant importance is placed on well intervention applications, such as cleanout techniques which may be utilized to remove debris from the well so as to ensure unobstructed hydrocarbon recovery.

Cleanout techniques as indicated above may be employed for the removal of loose debris from within the well. However, in many cases, debris may be present within the well that is of a more challenging nature. For example, debris often accumulates within a well in the form of 'scale'. As opposed to loose debris, scale is the buildup or caking of deposits at the surface of the well wall. The well wall may be a smooth steel casing within the well that is configured for the rapid uphole transfer of hydrocarbons and other fluids from a formation. However, a buildup of irregular occlusive scale may occur at the inner surface of the casing restricting flow therethrough. Scale may even form over perforations in the casing, thereby also hampering hydrocarbon flow into the main borehole of the well from the surrounding formation. Furthermore, scale buildup often occurs at shut-off safety valves, gas lift mandrels, and other completion assemblies. In addition to the occlusive nature of the scale, this particular type of buildup has the added disadvantage of interfering with the functionality of such features.

In order to address scale buildup as noted above, a variety of conventional techniques are available. Often times a less expensive gravity fed wireline technique is employed wherein chemical cleaners such as hydrochloric acid are delivered to downhole sites of scale buildup. More particularly, bailers disposed at the end of a wireline are filled with a chemical cleaning mix which is dumped on the scale buildup downhole. Unfortunately, scale buildup is generally resistant to passively delivered conventionally available chemical mix suitable for downhole use. For example, it is unlikely that calcium carbonate, barium sulfate and other crystalline scale deposits will be adequately removed by such techniques. Therefore, more extensive mechanically invasive cleanout as described below is generally required.

Scale may be removed by a variety of mechanical techniques such as the use of explosive percussion, impact bits, and milling. However, these techniques include the drawback of potentially damaging the well itself. Furthermore, the use of impact bits and milling generally fails to remove scale in its entirety. Rather, a small layer of scale is generally left behind which may act as a seed layer in encouraging new scale growth. As a result of these drawbacks, mechanical fluid jetting tools as described below may be most often employed for scale removal.

Fluid jetting tools are often deployed within a well to remove scale buildup as described above. A jetting tool may be conveyed into the well via coiled tubing and include a rotating head for jetting pressurized fluids, chemicals, solutions, beads, particles, penetrants toward the well wall in order to fracture and dislodge the scale. The rotating head may include fluid dispensing arms that project outward from a central axis of the tool and toward the well wall. Additionally, in many cases, the water may include a chemical mix or an abrasive in order to aid in the cutting into and fracturing of the scale as indicated.

The above noted jetting tools are delivered downhole to the site of the cleanout by way of coiled tubing. Unfortunately, in order for the application to take place, the well must be shut down and coiled tubing equipment, having a massive "footprint", must be delivered to the oilfield. For example, the coiled tubing, having a jetting tool at a downhole end thereof, may be driven through the well to the site of the cleanout through injector equipment. Additionally, a series of pumps, prime movers and control equipment may also be delivered to the oilfield in order to direct the coiled tubing cleanout application. As a result, several thousands of dollars more may be spent in running the coiled tubing cleanout application as compared to the above noted wireline cleanout.

Unfortunately, as indicated above, while more cost-effective, the more minimal wireline cleanout application remains largely ineffective at actually removing scale. Alternatively, while generally effective in achieving scale removal, the indicated coiled tubing cleanout techniques involve expenses that are so exorbitant, older scale ridden wells are often simply shut down rather than facing the prospect of running a coiled tubing cleanout application on them.

SUMMARY

A pressure actuated assembly for use in a well is provided. The assembly includes a plug, lock mandrel or similar anchor for setting or locating in the well and having a fluid channel therethrough. The assembly also includes a pressure actuated tool which is coupled to the plug. Thus, the plug may be configured to direct fluid uphole thereof through the fluid channel and to the pressure actuated tool.

A scale removal assembly for disposing in a hydrocarbon well is provided. The assembly includes a plug for disposing in the well to regulate fluid pressure uphole thereof. The assembly also includes a scale removal tool that is coupled to the plug and configured for scale removal downhole of the plug.

DETAILED DESCRIPTION

Embodiments are described with reference to certain scale removal tools and plug types. In particular, certain types of jetting tools coupled to bridge plugs are depicted and described. However, a variety of pressure actuated scale removal tools may be employed. For example, the scale removal jetting tools may be of a fixed or rotating configuration. Additionally, the jetting tools may be extendable to increase the size of the cleaning area, such as by employing a worm gear or screwdriver configuration, often referred to as a "Yankee screwdriver". Similarly, a variety of well plugs may be utilized, including both bridge and lock mandrel configurations. Regardless, embodiments described herein include pressure actuated tools utilized in combination with well plugs so as to allow a downhole pressurized application to proceed without the cost prohibitive requirement of coiled tubing deployment.

Figure 1:
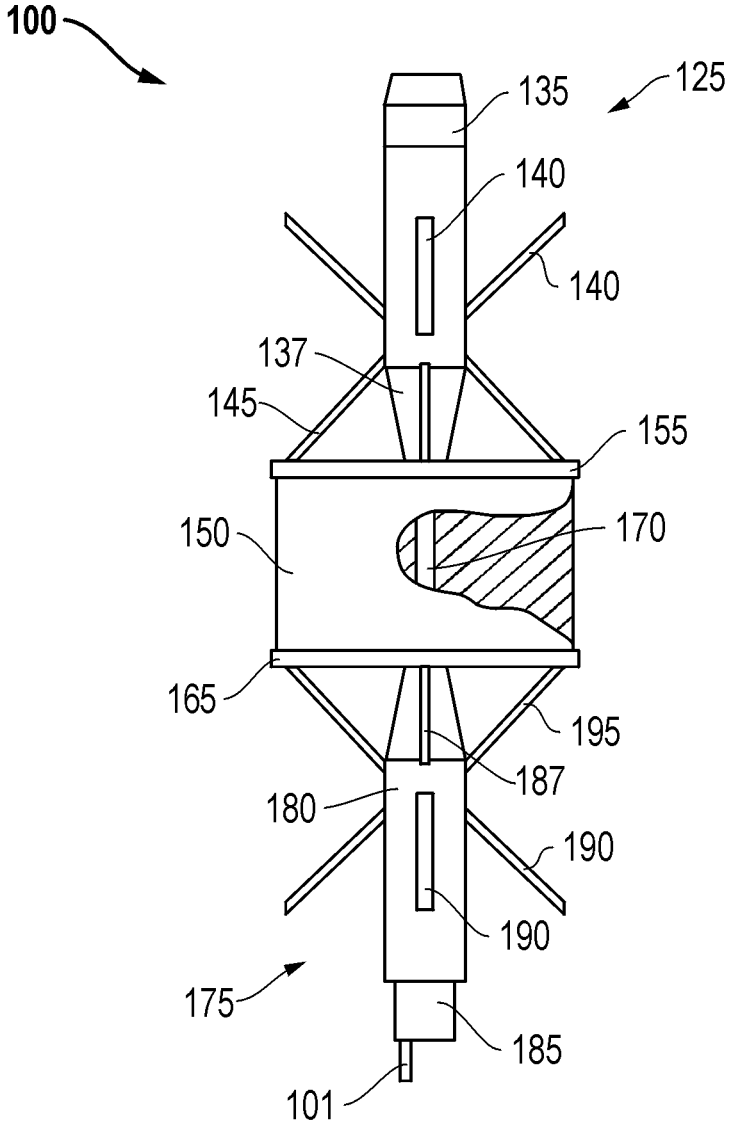
FIG. 1 is a partially sectional side view of an embodiment of a scale removal assembly.
Figure 2:
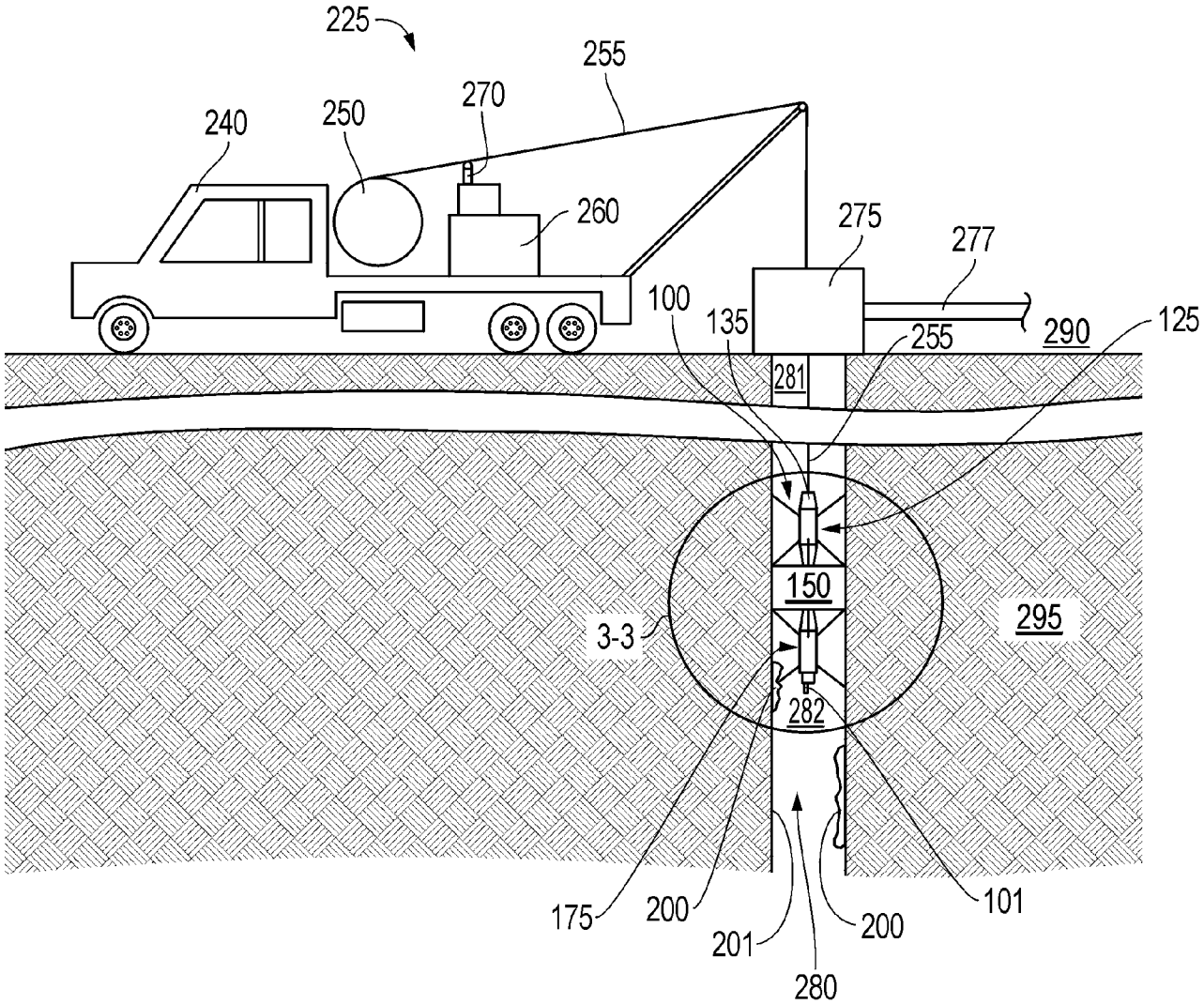
FIG. 2 is an overview of an oilfield with the scale removal assembly of FIG. 1 employed within a well.

Referring now to FIG. 1, with added reference to FIG. 2, an embodiment of a scale removal assembly 100 is shown. As detailed below, the assembly 100 is pressure actuated with a plug 150 for directing a fluid through to a scale removal tool. In the embodiment shown, the scale removal tool is a jetting tool with a nozzle housing 185 and a rotating dispense nozzle 101. That is, as detailed below, the housing 185 is configured to rotate the nozzle 101 about a central axis of the assembly 100 while directing pressurized fluid toward scale buildup 200 at a wall 201 of a well 280. However, in an alternate embodiment, the nozzle 101 may be of a fixed configuration to focus on scale removal from a particular location at the wall 201.

As depicted, the plug 150 of the scale removal assembly 100 is of a bridge configuration. That is, the plug 150 is positioned between an uphole anchor mechanism 125 and a downhole anchor mechanism 175. The bridge configuration allows the assembly 100 to be secured at just about any downhole location, for example, without particular concern over locating matching key slots in the well wall 201 to accommodate the assembly 100.

Once positioned at the proper cleanout location within a well 280, the anchor mechanisms 125, 175 are configured to immobilize the assembly 100 and compress the plug 150 therebetween so as to effectively plug the well 280. That is, the plug 150 may be of an expandable material such as a rubber-based material or an expandable polymeric material suitable for downhole use. Thus, uphole 140 and downhole 190 anchor arms of each mechanism 125, 175 respectively, may be employed to act against the well wall 201 in forcing uphole 155 and downhole 165 anchor plates toward one another in order to achieve the noted compression of the plug 150. That is, with stabilizing arms 145, 195 coupled to the plates 155, 165, the action of the anchor arms 140, 190 may be employed to drive the plates 155, 165 against the plug 150. This may proceed until the plug 150 expands to a profile effectively occluding the well 280 sealingly against the wall 201 thereof.

As indicated above, the well 280 may be occluded by the plug 150. Thus, the assembly 100 may be employed to aid in pressure regulation uphole thereof. For example, when a fluid is pumped into the well 280, the amount of fluid pressure in the well 280 above the plug 150 may be defined by the depth of the well 280 and pumping in combination with the occluding nature of the plug 150.

The plug 150 is also equipped with a fluid channel 170 so as to allow a controlled flow of fluid therethrough. That is, with respect to the embodiment shown, a fluid pathway which includes the fluid channel 170 may be present from one end of the assembly 100 to the other so as to allow fluid passage therethrough. For example, the uphole anchor mechanism 125 includes a head 135 which leads to an anchor housing 130 and ultimately an uphole coupling 137 which is secured to the uphole anchor plate 155, all of which may have a common fluid pathway therethrough leading to the depicted fluid channel 170. Similarly, the downhole anchor mechanism 175 includes the above noted rotating nozzle 101 and nozzle housing 185 which are coupled to the downhole anchor housing 180, coupling 187, and plate 165, all of which may also have a common fluid pathway leading to the fluid channel 170.

With the above described configuration of a scale removal assembly 100, fluid flow may be a matter primarily of whether or not the nozzle 101 is on or off. That is, by use of a plug 150 to isolate uphole fluid, the fluid may be pressurized and diverted to the nozzle 101 through a fluid pathway of the assembly 100 including the depicted fluid channel 170. As such, the nozzle 101 may be employed for pressurized scale removal as detailed further below, without the requirement of cost prohibitive coiled tubing deployment.

Continuing now with reference to FIG. 2, the well 280 is depicted running through a formation 295 at an oilfield 290. The scale removal assembly 100 is depicted at a cleanout location within the well 280. Buildup of scale 200 is shown at locations of the wall 201 of the well 280. However, the assembly 100 may be employed as detailed below in order to remove the scale 200. As described above, the assembly 100 is positioned with the plug 150 sealingly disposed relative to the wall 201 of the well 280 between uphole 125 and downhole 175 anchor mechanisms. As such, the plug 150 may be employed to at least partially define and regulate pressure and/or communication between uphole 281 and downhole 282 portions of the well 280. As indicated above, and detailed further below regarding FIGS. 3A-3B, this allows for a pressurized fluid cleanout application to proceed through the nozzle 101 without requiring coiled tubing deployment.

With continued reference to FIG. 2, conventional wireline equipment 225, as opposed to coiled tubing equipment, is depicted at an oilfield 290. The cost effective, smaller footprint, equipment 225 may be employed in order to run a cleanout application in the well 280 with the scale removal assembly 100. In the embodiment shown, a wireline truck 240 is shown for mobile delivery of a spool 250 of wireline cable 255 to the oilfield 290. The truck 240 may be equipped with a control unit 260 and metering tool 270 to aid in guiding the operation. However, in the embodiment shown, aside from the foot-space required to accommodate the wireline truck 240, no other foot-space may be taken up at the oilfield 290 by the wireline equipment.

The above noted wireline equipment 225 may be employed with other equipment already at the oilfield 290 in order to keep space requirements at a minimum. For example, the wireline cable 255 is routed through a well head 275 over the well 280 and to the assembly head 135 of the scale removal assembly 100. However, a fluid line 277 may also already be routed through the well head 275 and to the well 280 for a host of other well applications. As such, scale removal fluid and pressure may be provided to the well 280, particularly at the uphole portion 281 thereof. That is, other pressurization equipment and pumps, generally present at the oilfield 290 for fracturing and other well applications, may be employed to provide the scale removal fluid and pressure. Thus, rather than employing coiled tubing for utilizing pressurized fluid for scale removal, a column of pressurized fluid may be provided for scale removal via the isolated uphole portion 281 of the well 280 as detailed hereinbelow.

Figure 3A:
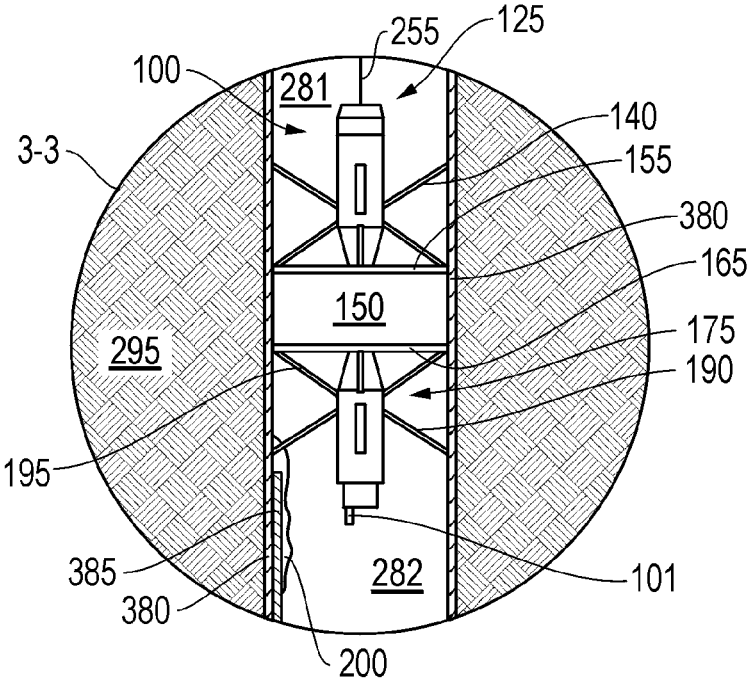
FIG. 3A is an enlarged view of the scale removal assembly of FIG. 2 positioned at a cleanout location within the well.
Figure 3B:
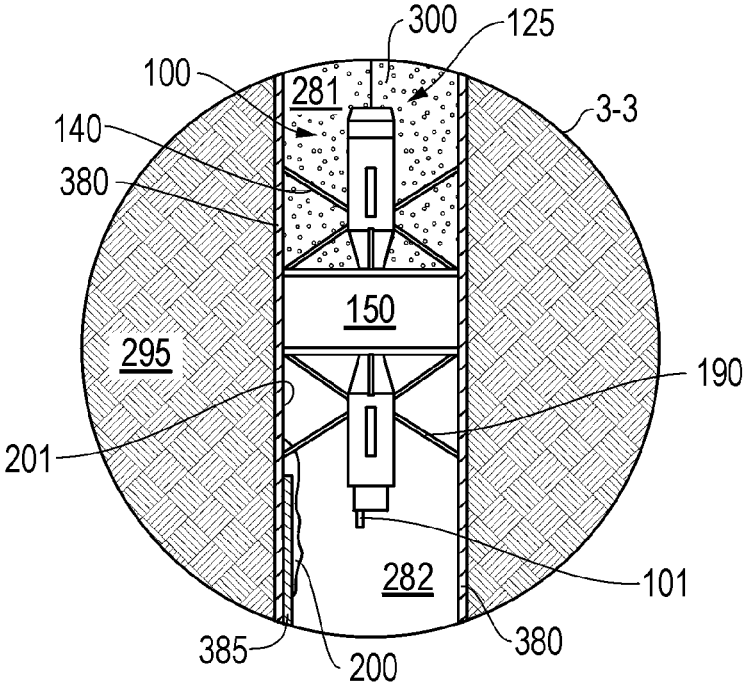
FIG. 3B is an enlarged view of the scale removal assembly of FIG. 3A with scale removal fluid pressurized thereabove in the well.
Figure 3C:
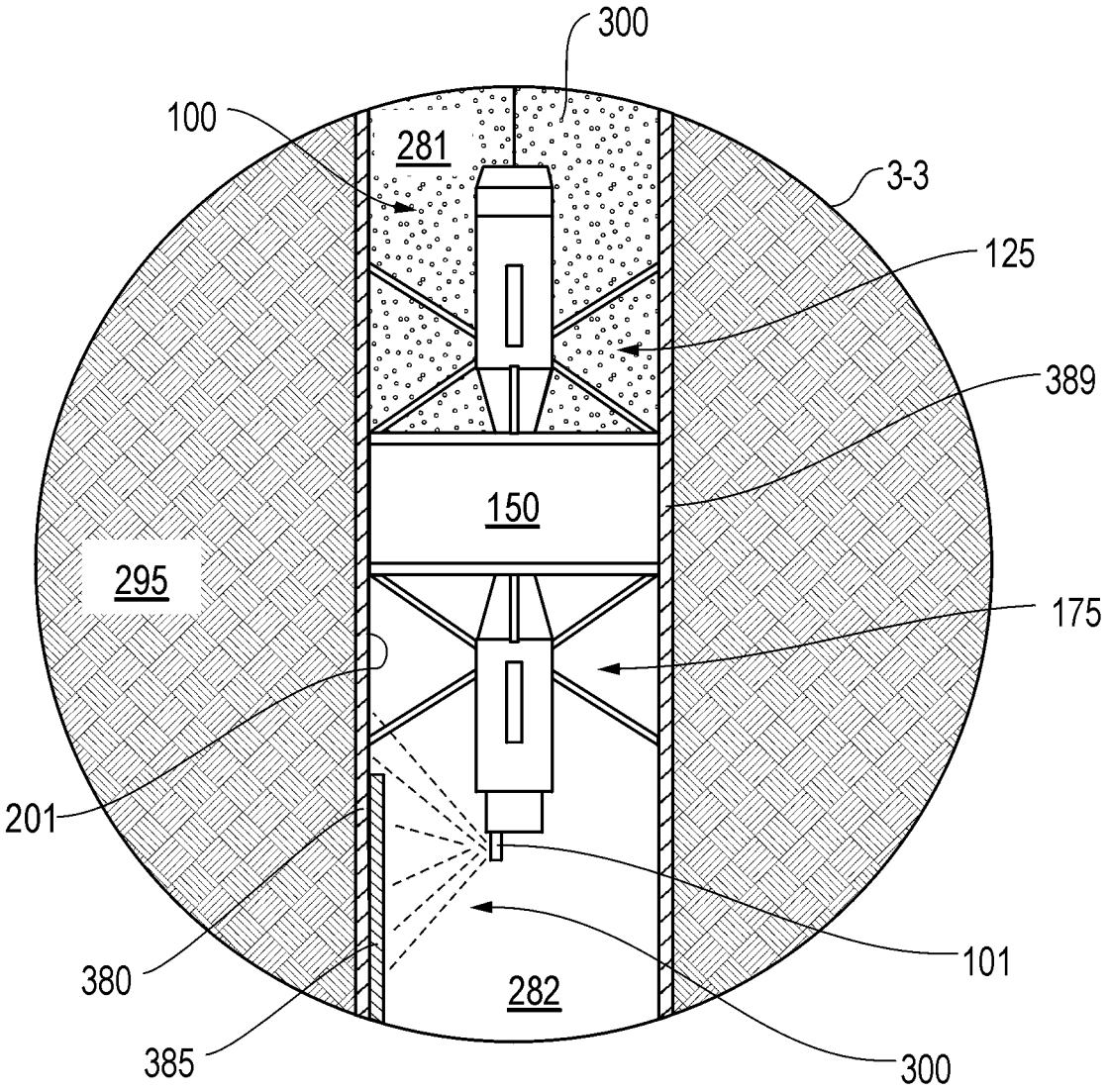
FIG. 3C is an enlarged view of the scale removal assembly of FIG. 3B with the scale removal fluid directed through a scale removal tool toward a wall of the well.

Referring now to FIGS. 3A-3C, with added reference to FIG. 2, methods of deploying and utilizing the scale removal assembly 100 is described. Beginning with FIG. 3A, the assembly 100 may be dropped downhole as directed by the control unit 260 at the oilfield 290. That is, the wireline equipment 225 may be utilized to drop the assembly 100, potentially several thousand feet, into the well 280 as depicted in FIG. 2 and to a cleanout location. Delivery of the assembly 100 in this manner positions it at a point immediately uphole of scale 200 to be removed as detailed below.

Once positioned at a cleanout location in the well 280, anchor arms 140, 190 may be actuated by conventional means to engage a borehole casing 380 defining the wall 201 of the well 280. Power for actuation of the arms 140, 190 may be carried to the assembly 100 by way of the wireline cable 255. However, in alternate embodiments, a downhole power source may be coupled to the body of the scale removal assembly 100 itself. Regardless, once engaged with the casing 380, the arms 140, 190 may act relative to one another so as to compress the plug 150, thereby slightly enlarging its profile. In this manner, a sealing engagement between the plug 150 and the wall 201 of the well 280 may be achieved. As depicted in FIGS. 3A-3C, this sealing engagement may define a separation between uphole 281 and downhole 282 portions of the well 280. Indeed, aside from communication through the assembly 100, the uphole portion 281 of the well 280 may be physically isolated from the downhole portion 282. This isolation may allow for fluid pressurization of the uphole portion 281 as detailed further below.

Continuing with reference to FIG. 3A, scale 200 is depicted over a shut-off valve 385. The shut-off valve 385 may be incorporated into the borehole casing 380 and provided as a manner of closing off the well 280 to hydrocarbon production. For example, a hydraulic line or other powering mechanism may be incorporated into the casing 380 and run to the shut-off valve 385 from the surface of the oilfield 290. In this manner, an operator at the surface may manually actuate the shut-off valve 385 to move from the vertical position depicted to a horizontal orientation, closing off the well 280. However, as shown in FIG. 3A, the buildup of scale 200 over the valve 385 may prohibit its proper operation. Thus, as is often the case, scale removal may be necessary in order to allow for a return to proper working order of a downhole device, in this case, a shut-off valve 385. However, gas lift mandrels and other downhole devices may be similarly affected.

Referring now to FIG. 3B, scale removal fluid 300 is shown in the isolated uphole portion 281 of the well 280. The fluid 300 may be pumped into the uphole portion 281 through conventional surface equipment, such as positive displacement pumps, coupled to the fluid line 277 of FIG. 2. Regardless, the uphole portion 281 may be sealed off by the assembly 100 as described above. Thus, an influx of fluid 300 may result in the development of significant pressure in the uphole portion 281. For example, in one embodiment, between about 500 and about 10,000 PSI may be generated within the uphole portion 281 and maintained thereat by the assembly 100. However, other pressures may be employed.

The above described scale removal fluid 300 may be water supplied to the oilfield 290 or a variety of other readily available fluid sources. For example, where the assembly 100 is employed in conjunction with offshore operations, the fluid 300 may be made up primarily of seawater. In one embodiment, the uphole portion 281 is initially filled to a specified volume with a more active scale removal fluid 300, such as an acid solution, with the remainder of the uphole portion 281 'backfilled' with seawater or other more inert and less expensive fluid to maintain pressure. Indeed a host of scale removal fluid 300 types may be employed. These may include mixtures of hydrochloric or other acids. Similarly, abrasives may be mixed therein to help promote scale removal.

Referring now to FIGS. 3B and 3C, the pressure within the uphole portion 281 may be taken advantage of for removal of the scale 200 from the wall 201 of the well 280. As depicted in FIG. 3B, the fluid 300, even under pressure, may be maintained within the uphole portion 281. This may be achieved by maintenance of the seal between the plug 150 and the casing 380 in conjunction with a closed dispense nozzle 101. That is, the dispense nozzle 101 may be located at the end of the fluid channel 170 of the plug 150 as depicted in FIG. 1 and thus, configured to control fluid flow therethrough. As such, with a closed nozzle 101 pressure in the uphole portion 281 may be maintained and/or increased as needed.

Continuing now with added reference to FIG. 3C, however, a jet of scale removal fluid 300 may eventually be emitted from the dispense nozzle 101 and directed at the scale 200 on the valve 385 and well wall 201. Opening of the nozzle 101 to achieve a jetting of the fluid 300 in this manner may be directed from the surface of the oilfield 290. For example, in one embodiment, the opening of the nozzle 101 may be directed through the control unit 260 of the wireline truck 240 as depicted in FIG. 2. Regardless, as shown in FIG. 3C, the pressurized fluid 300 may be employed to restore the valve 385 to proper working order.

In the embodiment shown, the nozzle 101 is of a rotating configuration. Thus, a pressurized jet of scale removal fluid 300 may be directed circumferentially about the entire surface 201 of the well 280. As such, scale removal may be achieved as needed beyond the location of the valve 385. Furthermore, the scale removal takes place with the entire assembly 100 anchored roughly at the axial center of the well 280. Thus, an added degree of control and precision may be provided to the cleanout application. Additionally, as depicted in FIG. 2, other regions of the well 280 may have a buildup of scale 200. Therefore, the scale removal assembly 100 may be de-anchored and repositioned to a new scale removal location at a different part of the well 280. Re-anchoring, pressurizing and jet cleaning of the new location may thus proceed in the manner detailed above.

Figure 4:
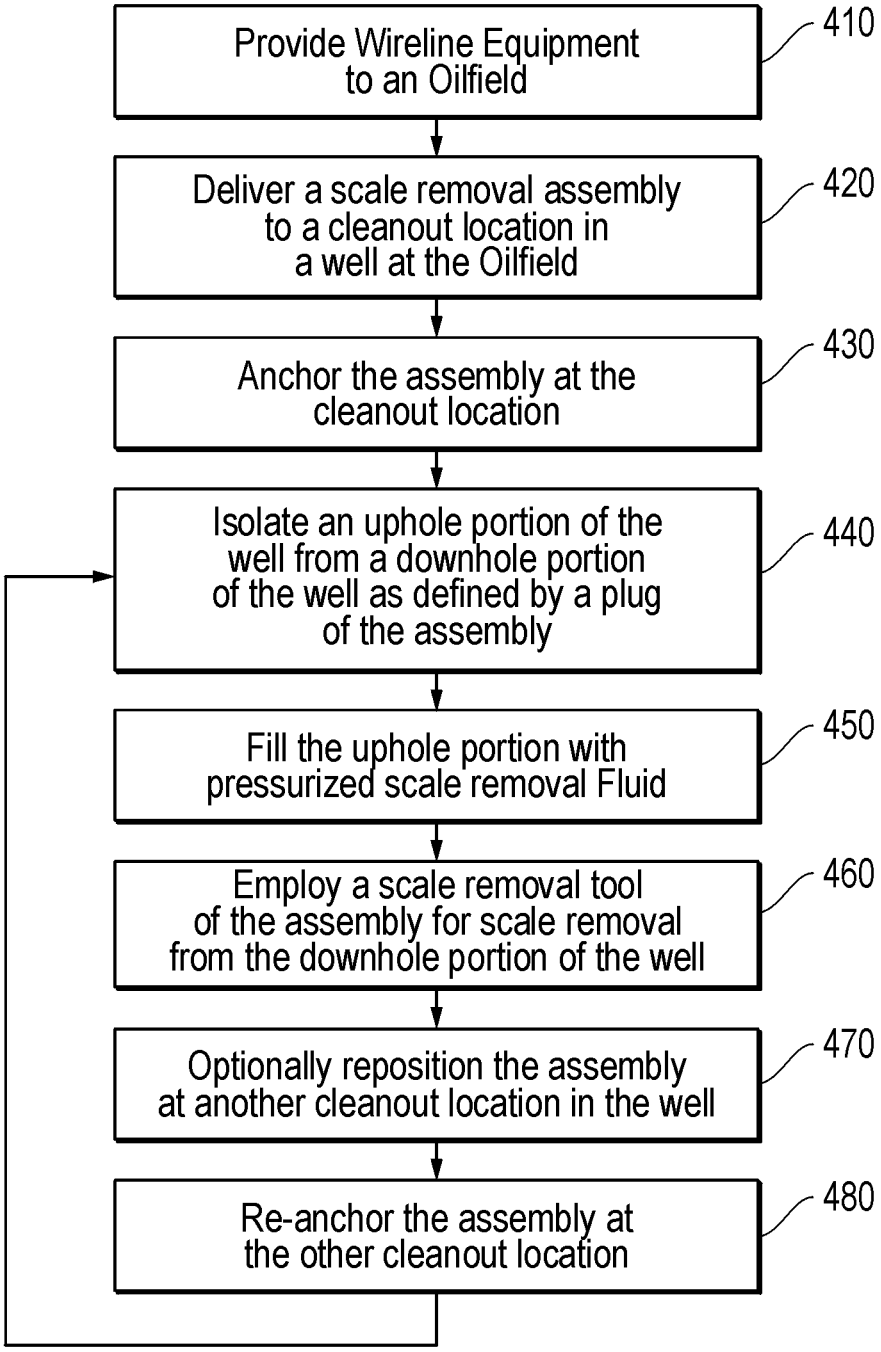
FIG. 4 is a flow-chart summarizing an embodiment of employing a scale removal assembly.

Referring now to FIG. 4, a flow-chart summarizing an embodiment of employing the scale removal assembly 100 is described. Namely, as indicated at 410 and 420, wireline equipment may be delivered to an oilfield. This minimal foot-space requiring equipment may be employed to deliver a scale removal assembly to a cleanout location in a well at the oilfield. As such, the need for more massive coiled tubing equipment may be obviated.

Once delivered to the cleanout location, the scale removal assembly may be anchored in position as indicated at 430 with a plug of the assembly employed to sealingly engage a wall of the well. Thus, as indicated at 440, the plug may isolate an uphole portion of the well from a downhole portion of the well as defined by the plug itself. As such, the uphole portion of the well may be filled with pressurized scale removal fluid as indicated at 450.

A scale removal tool of the assembly, such as the jetting nozzle detailed above, may then be employed to direct pressurized scale removal fluid at scale in the downhole portion of the well immediately below the plug (see 460). In this manner, a pressurized column of scale removal fluid may be provided for the application without the need for coiled tubing. Rather, the column of pressurized scale removal fluid is maintained by the structure of the well itself, already in place. Furthermore, the assembly may be centered in the well during the cleanout. Thus, unlike the potentially 'wagging' or axially free end of a coiled tubing, the cleanout provided by the assembly may be more stable and controlled with a roughly even distribution of cleanout fluid directed at all portions of the well wall in the cleanout location.

As indicated at 470 and 480, the assembly may remain in the well for additional cleanouts at other locations in the well. That is, the assembly may be de-anchored and repositioned at another cleanout location where it may then be re-anchored. Thus, subsequent cleanouts at a host of other locations within the well may proceed in the same manner as detailed above.

Figure 5:
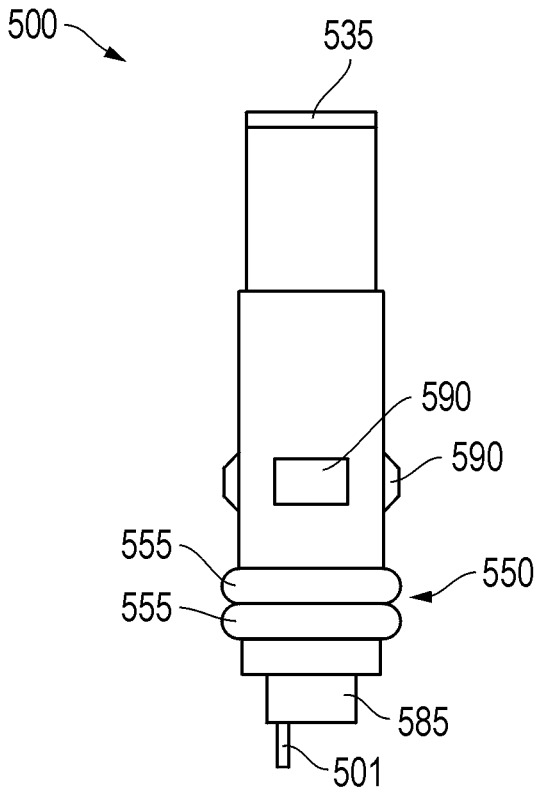
FIG. 5 is a side depiction of an alternate embodiment of a scale removal assembly.

Continuing now with reference to FIG. 5, an alternate embodiment of a scale removal assembly 500 is depicted. That is, as opposed to a bridge plug configuration as detailed above, the assembly 500 may take the form of a lock mandrel configuration. A lock mandrel configuration of the assembly 500 may be particularly beneficial for anchoring at predetermined locations in the well. For example, the well may be equipped with particularly located mating features for securing dog protrusions 590 of the assembly 500. In this manner, the mating features may be located near well features thought to be susceptible to scale buildup, such as the noted shut-off valve 385 of FIGS. 3A-3C. Thus, a potentially more precise and/or stable manner of anchoring the assembly 500 at a cleanout location may be provided.

As depicted in FIG. 5, the assembly 500 includes a head 535 for securing to a conventional wireline 255 such as that of FIG. 2. Additionally a plug 550 is provided for sealing against the well wall. In the embodiment shown, the plug 550 is made up of multiple circumferential seals 555. In one embodiment, the seals 555 are inflatable in order to achieve effecting sealing against the well wall. However, other plug configurations may be employed. Additionally, as shown in FIG. 5, a nozzle housing 585 and rotating dispense nozzle 501 are provided to the assembly in order to achieve the cleanout as detailed above. Nevertheless, as indicated above, alternate forms of scale removal tools may be incorporated into the assembly 500.

Embodiments described hereinabove include scale removal assemblies and techniques that provide for effective scale cleanout without the need for cost prohibitive and massive footprint occupying coiled tubing equipment. Nevertheless, the assemblies and techniques detailed provide for a pressurized manner of scale removal that does not leave the operator with the sole option of a largely ineffective passive chemical cleanout.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments detailed hereinabove focus on cleanout applications applied to cased wells. However, embodiments such as those detailed above may be employed for removal of debris from open hole wells. Additionally, while embodiments above focus on assemblies for scale removal applications, other downhole pressure actuated applications may employ assemblies similar to those detailed herein. These may include assemblies employed as cutting or drilling tools or assemblies employing downhole perforation guns. Furthermore, the foregoing description should not be read as pertaining only to the precise structures described and shown in the accompanying drawings, but rather should be read as consistent with and as support for the following claims, which are to have their fullest and fairest scope.

I claim:

1. A pressure actuated assembly for use in a hydrocarbon well, the assembly comprising:

a plug for disposing in and sealably engaging a casing cemented into the well while immobilized in the well, said plug having a fluid channel therethrough, said plug isolating a pressurized fluid filling the well uphole of the plug from the portion of the well downhole of the plug;

a first anchor mechanism located adjacent one end of the plug, wherein the first anchor mechanism comprises a first anchor arm, a first stabilizing arm, and a first anchor plate;

a second anchor mechanism located adjacent another end of the plug, wherein the first anchor mechanism comprises a first anchor arm, a first stabilizing arm, and a first anchor plate, wherein the anchor mechanisms, when actuated, cooperate to cause the plug to sealably engage the casing and to immobilize the plug; and a pressure actuated tool coupled to said plug that applies an application of the pressurized fluid downhole thereof, wherein said plug directs said pressurized fluid uphole thereof through the fluid channel to said pressure actuated tool.

2. The pressure actuated assembly of claim 1 wherein said pressure actuated tool is selected from the group consisting of a scale removal tool, a scale cutting tool, a drilling tool, and a perforation gun.

3. The pressure actuated assembly of claim 1 wherein said plug is of an expandable material for the engaging.

4. The pressure actuated assembly of claim 3 wherein the material is one of compressible and inflatable.

5. The pressure actuated assembly of claim 1 wherein said plug is selected from the group consisting of a bridge configuration and a locking mandrel configuration.

6. The pressure actuated assembly of claim 5 wherein the locking mandrel configuration comprises multiple circumferential seals for the engaging.

7. A scale removal assembly for disposing in a hydrocarbon well, the assembly comprising:

a plug disposed adjacent the anchor mechanism for disposing against the casing in the well thereby regulating pressure of a pressurized fluid in the well uphole thereof;

a first anchor mechanism located adjacent one end of the plug, wherein the first anchor mechanism comprises a first anchor arm, a first stabilizing arm, and a first anchor plate;

a second anchor mechanism located adjacent another end of the plug, wherein the first anchor mechanism comprises a first anchor arm, a first stabilizing arm, and a first anchor plate, wherein the anchor mechanisms, when actuated, cooperate to cause the plug to sealably engage the casing and to immobilize the plug; and a jetting tool fluidly coupled to said plug, wherein said jetting tool employs the pressurized fluid regulated uphole in the well to remove scale from the casing downhole thereof.

8. The scale removal assembly of claim 7 wherein said jetting tool comprises a dispense nozzle of a configuration that is selected from the group consisting of fixed, rotating, and extendable.

9. The scale removal assembly of claim 7 wherein said jetting tool is configured to be substantially centered axially relative to the well by said plug.

10. A method of employing a pressure actuated tool in a well, the method comprising:

disposing a plug located between two anchor mechanisms in the well with the pressure actuated tool coupled thereto, wherein each anchor mechanism comprises an anchor arm, a stabilizing arm, and an anchor plate;

delivering the plug and the pressure actuated tool into the well with wireline equipment without the use of an additional tubing line;

actuating the anchor mechanisms to expand the plug to place the plug in sealing engagement with the casing and immobilize the plug, wherein actuating the anchor mechanisms comprises engaged the casing with the anchor arms, and using force from the anchor arms to drive the anchor plates toward one another, thereby expanding the plug;

filling the uphole portion of the well with a pressurized fluid; and directing the pressurized fluid from the uphole portion of the well to the pressure actuated tool in the downhole portion of the well.

11. The method of claim 10 wherein said directing comprises channeling the pressurized fluid from the uphole portion through a fluid channel in the plug and to the pressure actuated tool.

12. The method of claim 10 wherein the pressure actuated tool is a scale removal tool, the method further comprising removing scale from the casing of the well by application of the pressurized fluid thereat with the scale removal tool.

13. The method of claim 12 wherein the pressurized fluid is at a pressure of between about 500 PSI and about 10,000 PSI for the application.

14. The method of claim 12 wherein said disposing is at a first location in the well, the method further comprising:

repositioning the plug and the pressure actuated tool to a second location in the well; and removing scale from the casing at the second location with the pressure actuated tool.

15. A system comprising:

a pressure actuated assembly having a plug located between two anchor mechanisms and a pressure actuated tool coupled thereto, wherein the anchor mechanisms are selectively actuated to immobilize the plug at a desired location and drive a pair of anchor plates toward one another, thereby, placing the plug in sealing engagement with a casing cemented in a well, wherein when the plug is immobilized and in sealing engagement with the casing the plug isolates a pressurized fluid in the well uphole of the plug from the portion of the well downhole of the plug, wherein the pressure actuated tool receives the pressurized fluid through the plug; and wireline equipment coupled to the assembly, the wireline equipment for positioning at an oilfield to deliver the assembly to the well without the use of an additional tubing line.

16. The system of claim 15 wherein the pressure actuated tool direct the pressurized fluid to the casing downhole of the plug.

17. The system of claim 16 wherein the fluid is a scale removal fluid, the pressure actuated tool directs the pressurized fluid to the casing downhole of the plug to remove scale from the casing of the well.

18. The system of claim 17 wherein the scale removal fluid is selected from the group consisting of water, acid, and an abrasive.

19. The system of claim 18 wherein the water comprises seawater.

20. The system of claim 18 wherein the acid comprises hydrochloric acid.

* * * * *